United States Patent [19]

Chion et al.

[11] Patent Number: 4,681,594

[45] Date of Patent: Jul. 21, 1987

[54] PROCESS FOR DISPERSE DYEING DRY-SPUN ATACTIC POLYVINYL CHLORIDE-BASED FILAMENTS AND FIBRES BEFORE DRAWING

[75] Inventors: Pierre Chion, Bar-Le-Duc; Jacques Menault, Charbonnieres-les-Bains, both of France

[73] Assignee: Rhovyl, Neuilly-sur-Seine, France

[21] Appl. No.: 838,352

[22] Filed: Mar. 11, 1986

[30] Foreign Application Priority Data

Mar. 26, 1985 [FR] France ..... 85 04619

[51] Int. Cl.[4] ..... D06B 3/04; D06P 1/16

[52] U.S. Cl. ..... 8/489; 8/494; 8/504; 8/508; 8/538; 8/928

[58] Field of Search ..... 8/489, 494, 504, 538

[56] References Cited

U.S. PATENT DOCUMENTS 3,533,729 10/1970 Mazzolini et al. ..... 8/538

4,591,361 5/1986 Cazzard et al. ..... 8/538

*Primary Examiner*—A. Lionel Clingman

*Attorney, Agent, or Firm*—Stevens, Davis, Miller & Mosher

[57] ABSTRACT

The invention relates to a process for continuous dyeing of filaments based on atactic polyvinyl chloride in the course of their production.

The undrawn filaments are impregnated with a composition containing at least one plastosoluble dye while they have a density of between 1.3 and 1.4 g/cm$^3$, are fixed continuously in the presence of steam under pressure at a temperature of between 100° and 120° C. for 2 to 20 seconds, are drawn in a known manner, are then fixed under tension in the presence of steam under pressure at a temperature of between 100° and 130° C. for 1 to 20 seconds, and are then oiled and shrunk in a known manner.

Such a process permits quick dyeing, on an industrial scale, with good color fastness.

5 Claims, No Drawings

PROCESS FOR DISPERSE DYEING DRY-SPUN ATACTIC POLYVINYL CHLORIDE-BASED FILAMENTS AND FIBRES BEFORE DRAWING

The present invention relates to a process for continuously dyeing filaments and fibres based on polyvinyl chloride during their production.

PVC-based fibres are valued in the textile sector because of certain special properties: nonflammability, light resistance, chemical inertness, and their ability to provide thermal, electrical and sound insulation.

Textiles based on polyvinyl chloride are usually coloured by dyeing in bulk during their production; however, while this process makes it possible to produce colours which have good fastness, any colour change produces constraints which make this process relatively uneconomical.

The fibres can also be dyed using an aqueous solution or dispersion of dyes, the most widely used dyes being disperse dyes and basic dyes. The dyes have no chemical affinity for the fibre, with the result that the dyed fibre consists of a solid solution of dye in the polymer. The dyeing process consists in producing this solution by placing the natural-coloured fibre in the presence of a solution or an aqueous dispersion of the dyes and in heating the whole to a temperature which makes it possible to speed up the rate of dye uptake without modifying the textile nature of the fibre.

Fibres made from atactic polyvinyl chloride are practically amorphous fibres, that is to say of very low crystallinity (which generally does not exceed 9%) which is that of the initial polymer.

As a result, a property of these fibres is that they shrink when subjected to a temperature above 100° C. and, while shrinking, they lose their mechanical properties: the strength drops and the elongation increases so that above 100° C. the processability of the said fibres becomes difficult or even impossible.

As a result of this, the processes for dyeing polyvinyl chloride-based fibres which are known at present do not exceed a temperature of 100° C. and require long dyeing times to compensate for the low temperature of fixing: the fibres can be dyed either in loose form or as tow, batchwise, and the dyeing operation then takes several hours. When they are in tow form, they can also be dyed continuously at temperatures of the order of 100° C., but residence times are too long, so that rates of dyeing are low and the processes are costly.

It has now been found that it is possible to dye fibres based on atactic polyvinyl chloride, continuously, at slightly elevated temperatures and very quickly, with good colour fastness.

More particularly, the present invention relates to a process for continuous dyeing of filaments based on atactic polyvinyl chloride, the filaments, after being dry-spun in a known manner, being impregnated with a composition containing at least one plastosoluble dye while they have a density of between 1.3 and 1.4 g/cm$^3$, and then being continuously fixed in the presence of steam under pressure, at a temperature between 100° and 120° C. for 2 to 20 seconds, and then being drawn in one or more stages in aqueous medium in a known manner, and then being fixed again under tension in the presence of steam under pressure at a temperature between 100° and 130° C. for 1 to 20 seconds, and then being oiled and shrunk in an aqueous fluid medium at a temperature between 98° C. and 130° C.

In the present application, the expression "polyvinyl chloride" is understood to mean:

ordinary vinyl chloride homopolymer, which is predominantly atactic (that is to say produced by thermal polymerization) with a number-average molecular weight Mn of 50,000 to 120,000, preferably 60,000 to 90,000, and a second-order transition temperature Tg of 65° to 85° C., and an AFNOR index of approximately 120 (according to the Standard AFNOR T 51 013).

copolymers containing at least 85% by weight of vinyl chloride and up to 15% of a comonomer which is copolymerizable with vinyl chloride, such as vinyl acetate, vinyl and (meth)acrylic esters and ethers, acrylonitrile, olefins such as ethylene, and the like.

mixtures of polyvinyl chloride or a vinyl chloride copolymer as defined above with another polymer, so as to improve the characteristics of the articles produced (for example dye affinity or heat resistance).

Among these polymers, there can be mentioned cellulose esters, cyanoethylated cellulose, polyvinyl alcohol modified by ester sites, or cyanoethylated, polyacrylonitrile, chlorinated polyvinyl chloride whose second-order transition temperature is generally at least 100° C., with an AFNOR index of approximately 110, the atactic polyvinyl chloride or its copolymer being present in the mixture of polymers in a proportion of at least 75% and preferably 80%, but provided that the mixture of polymers which are obtained contains at least 75% or 80% by weight of predominantly atactic vinyl chloride units.

Within the scope of the present invention, ordinary vinyl chloride homopolymer is used in preference.

The filaments and fibres according to the present invention are prepared according to the process known as dry-spinning from solution of polymer at a concentration which is generally between 20 and 30% by weight.

After the dry-spinning, the filaments originating from several dies are generally combined into a tow, in the case of production on an industrial scale, and are impregnated preferably by the padding technique, by means of a composition containing at least one plastosoluble dye and, preferably, also adjuvants such as thickening agents, wetting agents and acidifying agents, generally dispersed in demineralized water or any other suitable carrier.

The best dyeing results are obtained when the temperature of the impregnation bath is between 60° and 90° C., preferably between 70° and 80° C., the density of the fibres being between 1.3 and 1.4 g/cm$^3$.

The colour yield, determined as the exchange coefficient K (ratio of the quantity of the impregnation bath which is actually taken to the theoretical quantity represented by the water content of the fibre) is also improved when the number of passes of the filaments in the impregnation bath is increased; the number of passes can vary from 1 to 3, for example, without any marked decrease in the process yield.

The dye concentration is determined to produce the required shade, account being taken of a specified mangle expression which corresponds to the relationship:

$$E = \frac{\text{Weight of material after padding} - \text{weight of dry material}}{\text{Weight of dry material}} \times 100$$

The mangle expression is generally between 15 and 25% and corresponds to the quantity of bath absorbed by the filaments.

It has been found that to obtain good shade fastness the density of the fibres must be between 1.3 and 1.4 g/cm$^3$, whilst, at the time of impregnation, the water content of the filament roving is between 10 and 30%, preferably between 15 and 25% by weight under a slight tension. The water content of the filaments is due to the interstitial water entrained in the process, that is to say the water present between the fibres. It is thus not a question of water present in the filaments, whose structure, after dry-spinning, is substantially water-free.

After the impregnation phase, the undrawn filaments are fixed in the presence of steam under pressure, continuously, at a temperature above 100° C., preferably between 100° and 120° C.; the residence time in the fixing system being between 2 and 20 seconds, preferably between 5 and 15 seconds.

It is wholly surprising that a fixing period as short as this permits the dye to be properly fixed, bearing in mind the concentration of the impregnating composition.

The tow tension can be adjusted so that a shrinkage is produced if appropriate; the stress is generally between 0.065 g/dtex and 0.0150 g/dtex.

The filaments are then drawn in one or more phases in hot water troughs maintained at temperatures between 80° and 100° C., preferably between 85° and 98° C., to ratios of between 4 and 7×, preferably 5 to 6×, and are then fixed under tension, continuously, in the presence of steam under pressure, at a temperature between 100° and 130° C., for 1 to 20 seconds, preferably 4 to 10 seconds.

The filaments, oiled in a known manner, undergo a shrinkage treatment in the free state, a treatment which can be carried out in boiling water for a variable period, for example at least 10 minutes, generally 10 to 20 minutes or even longer, or in saturated steam, for example by being passed through a nozzle such as described in French Pat. No. 83 329/1,289,491. In this nozzle, the filaments are treated with saturated steam at a temperature between 105° and 130° C. and are simultaneously shrunk and crimped, which permits better textile processability afterwards.

Similarly, when the shrinkage is carried out in boiling water, it is preferably preceded by mechanical crimping.

Such a process can be carried out continuously up to the shrinkage phase, which permits it to be used with ease industrially, and which is of major economic interest.

To accomplish a particularly economical industrial implementation, the present invention is applied to tows comprising a large number of filaments, that is to say produced by spinning in several spinning cells, to produce tows containing at least 100,000 filaments and capable of going up to 1 million filaments or even more.

The fibre density is measured after freeze-drying at a temperature of the order of −15° C. at a pressure of 80 to 90 millitorrs, in the following manner:

Basis of the method:

A first weight of the specimen is determined in air: M=vd (disregarding air pressure).

A second weight is determined after immersion in a silicone oil of density d':

$$M' = Vd - Vd'$$

This gives:

$$d = \frac{M}{M - M'} d'$$

Apparatus:

Numbered specimen-carrier baskets.

Crystallizing dish, 20 cm in diameter.

Desiccator, 22 cm in diameter, with a tap.

Vacuum pump (capable of 1 mm Hg).

Balance, capable of weighing to 1/10, with provision for weighing from below.

15-den. nylon thread with a small hook.

Bath, thermostatted to within 1/10 of a degree, placed under the balance.

3-liter beaker.

Thermometer which can be read to within 1/10 of a degree.

Aluminium electrode (Messrs. F.C. Dannatt, 198, rue St-Jacques PARIS 5e), 6.25 mm in diameter by 15 cm in height, with a hole at one end.

Reactant:

Silicone oil 47 V 50 (Rhône-Poulenc), approximately 5 liters.

Specimen:

Variable weight of between 1 and 3 grams. (The accuracy will be proportionately better, the greater the weight).

Operating procedure : measurement as such

Tie the nylon thread attached to the balance hook so that it no longer touches the immersion liquid.

Zero the balance.

Weigh the specimen on the balance pan M.

Place it in a basket which has been calibrated beforehand by weighing in the oil at the test temperature - weight: m (tare).

Immerse the basket in the crystallizing dish containing the silicone oil.

Place the crystallizing dish in the desiccator which is then connected to the vacuum pump (at the beginning of the degassing, it is advisable to watch the operation closely: when the air in the specimen escapes too abruptly, there is a risk that it will pull the thread out of the basket or will give rise to intense boiling which could cause the oil to overflow from the crystallizing dish; should this happen, stop the pump for a moment or two and restart it when the boiling subsides).

Allow to degas for half an hour, making the desiccator vibrate during the last 10 minutes to facilitate the release of air.

Close the desiccator tap.

Stop and disconnect the vacuum pump.

Release the vacuum inside the desiccator very slowly.

Transfer the specimen-carrier baskets quickly into the thermostatted oil bath.

Allow the temperature to stabilize for approximately 6 hours (this time depends on the external temperature and on the number of specimens). The temperature should be controlled to within 1/10 of a degree.

Untie the nylon thread and dip the little hook in the oil.

Zero the balance.

Attach the basket to the hook, being careful not to take it out of the liquid (use another hook with a long rigid rod for this purpose).

Determine the weight: m', from which the weight M' of the immersed specimen will be deduced:

$$M' = m' - m$$

Expression of the result: Density $$d = \frac{M}{M - M'} d'$$

d' being the density of the silicone oil at the test temperature, the silicone oil having been standardized beforehand.

The fastness of the shades to washing and to light is determined according to ISO Standards 105-E-01 and 105-B-01, respectively.

EXAMPLE 1

A solution of atactic polyvinyl chloride (AFNOR index 120, chlorine content 56.5%) in a carbon disulphide/acetone mixture, 50/50 by volume, is prepared, the concentration of polymer being 28%.

The solution, maintained at 70° C., is dry-spun in a known manner through a 900-hole die. Filaments produced by a number of dies are collected together to produce a tow containing 180,000 filaments.

The filaments containing 18% by weight of water are then impregnated with a bath maintained at 80° C. and comprising:

100 g/l of plastosoluble dye (CI "Red 4"), 2 g/l of a wetting agent of the sulphonated polyglycol ester type, known under the trademark "Uniperol W" (BASF), 2 g/l of a dispersing agent which is a mixture of a solvent and an anionic fatty acid derivative known under the trademark "Sylvatol 1" (Ciba), 10 g/l of a thickener of the esterified polyacrylonitrile type, known under the trademark Solidokoll K (Hoechst), 1 cc/l of acetic acid, so that the pH of the bath is maintained between 4 and 5, demineralized water to make up to 100%.

The mangle expression of the bath is 20% and the exchange coefficient of the dye "CI Red 4" is 72%.

The impregnated filaments are fixed continuously with-steam under pressure at a temperature of 118° C. for 8 seconds and are drawn in an aqueous bath at 98° C. to a ratio of 5×.

They are then stabilized in the presence of steam under pressure, and under tension, at a temperature of 112° C. for 6 seconds, and are then subjected to a shrinkage in a boiling water bath for approximately 20 minutes and are crimped mechanically.

The filaments obtained have a tenacity of 20 cN/tex, an elongation of 80% and a final gauge of 3.3 dtex.

Their fastness to washing is 5 and to light 4.

EXAMPLES 2 AND 3

A polyvinyl chloride identical to that used in Example 1 is spun and a tow is impregnated with the same composition, but a double impregnation using the padding bath is carried out in the one case, and a triple impregnation in the other case.

The exchange coefficient is 93% in the case of the double impregnation and 98% in the case of the triple impregnation.

The filaments are then fixed in the presence of steam under pressure at 118° C. for 8 seconds, and are then drawn, stabilized and shrunk in the same manner as according to Example 1. Their fastness values are as follows:

Fastness to washing: 5–6

Fastness to light: 4–5.

What is claimed is:

1. In a process for continuously dyeing filaments based on atactic polyvinyl chloride, which are obtained by dry spinning, drawn in at least one step, oiled and shrunk, the improvement comprising impregnating the undrawn filaments in an impregnating bath containing a dyestuff maintained at a temperature of between 60° and 90° C. and containing at least one plastosoluble dye, while the filaments have a density of between 1.3 and 1.4 g/cm$^3$, fixing continuously in the presence of steam, under pressure at a temperature of between 100° and 120° C. for 2 to 20 seconds, and thereafter maintaining the filaments under tension between 0.065 g/dtex and 0.0150 g/dtex while they are fixed in the presence of steam, under pressure, at a temperature of between 100° and 130° C. for 1 to 20 seconds.

2. Process according to claim 1, characterized in that the impregnation is carried out by padding.

3. Process according to claim 1, characterized in that the number of passes of the filaments in the impregnating bath is 1, 2 or 3.

4. Process according to claim 1, characterized in that the treatment of fixing directly after impregnating is carried out for 5 to 15 seconds.

5. Process according to claim 1 characterized in that the treatment of fixing after drawing is carried out for a period of 4 to 10 seconds.

* * * * *